United States Patent [19]

Agrawal et al.

[11] Patent Number: 4,662,916

[45] Date of Patent: May 5, 1987

[54] PROCESS FOR THE SEPARATION OF AIR

[75] Inventors: Rakesh Agrawal; Thomas E. Cormier, Sr., both of Allentown, Pa.

[73] Assignee: Air Products and Chemicals, Inc., Allentown, Pa.

[21] Appl. No.: 869,142

[22] Filed: May 30, 1986

[51] Int. Cl.[4] ..... F25J 5/00

[52] U.S. Cl. ..... 62/13; 62/39; 62/43

[58] Field of Search ..... 62/11, 13, 31, 38, 39, 62/43

[56] References Cited

U.S. PATENT DOCUMENTS

| | | | |
|---|---|---|---|
| 2,627,731 | 2/1953 | Benedict | 62/34 |
| 2,982,108 | 5/1961 | Grunberg et al. | 62/28 |
| 3,492,828 | 2/1970 | Ruckborn | 62/13 |
| 3,736,762 | 6/1973 | Toyama et al. | 62/13 |
| 4,222,756 | 9/1980 | Thorogood | 62/13 |
| 4,303,428 | 12/1981 | Vandenbussche | 62/38 |
| 4,400,188 | 8/1983 | Patel et al. | 62/13 |
| 4,410,343 | 10/1983 | Ziemer | 62/43 |
| 4,464,188 | 8/1984 | Agrawal et al. | 62/13 |

*Primary Examiner*—Ronald C. Capossela

*Attorney, Agent, or Firm*—Willard Jones, II; James C. Simmons; E. Eugene Innis

[57] ABSTRACT

A process is set forth for the separation of air by cryogenic distillation in a single column to produce a nitrogen product and an oxygen-enriched product. In the process, at least a portion of the nitrogen product is compressed and recycled to provide reboil at the bottom of the distillation column and to provide some additional reflux to the upper portion of the column. In addition, part of the compressed feed air stream is expanded to provide work, which is used to drive an auxiliary compressor for feed air substream compression.

23 Claims, 4 Drawing Figures

PROCESS FOR THE SEPARATION OF AIR

TECHNICAL FIELD

The present invention is directed to the separation of air into its constituents, nitrogen and oxygen. Specifically, the invention is directed to the cryogenic distillation of air to produce a nitrogen product and an oxygen-enriched product.

BACKGROUND OF THE PRIOR ART

The prior art has recognized the need to perform air separation, particularly for the recovery of nitrogen with greater efficiency. With the increasing cost of energy and the need for large quantities of separated gas such as nitrogen for enhanced petroleum recovery, highly efficient separation processes and apparatus are necessary to provide competitive systems for the separation and production of the components of air, most particularly nitrogen.

In U.S. Pat. No. 2,627,731 a process for the rectification of air into oxygen and nitrogen is described wherein a two sectioned or single distillation column are used alternatively. Air is cooled by heat exchange and introduced directly into the distillation column. A nitrogen product is removed from the overhead of the column and a portion is compressed in two stages. The first stage nitrogen compressed stream is recycled in order to reboil and condense a portion of the midpoint of the column by indirect heat exchange before being introduced into the overhead of the column as reflux. A second stage compressed nitrogen stream is recycled and partially expanded to provide refrigeration. This expanded stream is recycled to the nitrogen product line. The remaining stream of the second stage compressed nitrogen stream reboils the bottom of the column before being combined with the first stage compressed nitrogen stream and introduced into the overhead of the column as reflux.

In U.S. Pat. No. 2,982,108, an oxygen producing air separation system is set forth wherein a portion of the nitrogen generated from the distillation column is compressed and reboils the base of a high pressure section of the column before being introduced as reflux to the low pressure section of the column. The feed air stream is supplied in separate substreams into the high pressure section of the column and in an expanded form into the low pressure section of the column.

U.S. Pat. No. 3,492,828 discloses a process for the production of oxygen and nitrogen from air wherein a nitrogen recycle stream is compressed and condensed in a reboiler in the base of a distillation column before being reintroduced into the column as reflux. A portion of the nitrogen recycle stream may be expanded in which the power provided by the expansion drives the compressor for the main nitrogen recycle stream.

In U.S. Pat. No. 3,736,762, a process for producing nitrogen in gaseous and liquefied form from air is set forth. A single distillation column is refluxed with nitrogen product condensed in an overhead condenser operated by the reboil of oxygen conveyed from the bottom of said column. At least a portion of the oxygen from the overhead condenser is expanded to produce refrigeration for the process.

In U.S. Pat. No. 4,222,756, a process is set forth in which a two pressure distillation column is used in which both pressurized column sections are refluxed with an oxygen-enriched stream. The low pressure column is fed by a nitrogen-enriched stream from the high pressure column which is expanded to reduce its pressure and temperature.

U.S. Pat. No. 4,400,188 discloses a nitrogen production process wherein a single nitrogen recycle stream refluxes a distillation column which is fed by a single air feed. Waste oxygen from the column is expanded to provide a portion of the necessary refrigeration.

In U.S. Pat. No. 4,464,188 a process and apparatus is set forth for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

Although the prior art has taught numerous systems for the separation of air and particularly the production of a nitrogen product from air, these systems have been unable to achieve the desired efficiencies in power consumption and product recovered which are necessary in the production of large volumes of air components, such as nitrogen.

BRIEF SUMMARY OF THE INVENTION

The present invention is directed to a process for the separation of air by cryogenic distillation in a single distillation column which comprises compressing a feed air stream to an elevated pressure and aftercooling the pressurized air stream. Water and carbon dioxide is removed, preferably in a molecular sieve unit, to prevent the freezing of these impurities in the process. The feed air stream is split into three substreams. The first substream is cooled in heat exchange against other process streams before it is introduced into the distillation column. The second substream is compressed and cooled in heat exchange against process streams; and is used to reboil the distillation column before being reduced in pressure and introduced into the column as reflux. The third substream is warmed, compressed, cooled and expanded to recover work. It is then further cooled and introduced into the column. A nitrogen product stream and an oxygen-enriched stream are separated in and removed from said distillation column. A portion of the nitrogen product stream is condensed against the oxygen-enriched stream and is returned it to the column as reflux. The remaining nitrogen product stream is rewarmed by heat exchange against process streams. At least a portion of the product stream is compressed to an elevated pressure. A nitrogen recycle stream is split from the compressed nitrogen product stream, cooled against process streams, and used to reboil the distillation column before being reduced it in pressure and introduced into the column as reflux.

Three variations on the above scheme are possible. In the first variation, the water and carbon dioxide free air is split into two substreams, instead of three. The first feed air substream is cooled and is fed to the distillation column at an intermediate location. The second substream is compressed, cooled and expanded. The expanded substream is cooled, condensed in reboiler, further cooled and expanded, and fed to the distillation column at an intermediate location.

In the second variation, the water and carbon dioxide free feed air stream is divided into three substreams. The only difference between this and the original process is that instead of being cooled and introduced directly to the distillation column the expanded air is condensed in an additional reboiler and is then mixed with condensed air feed from the other reboiler.

In the third variation, prior to water removal by the mole sieve unit, the feed air is split into two substreams. The first substream is compressed to a high pressure, cooled, and fed to a mole sieve unit for water and carbon dioxide removal. This high pressure substream, which is a large portion of the air feed, is split into two portions. A first portion is cooled in heat exchange with warming product streams and is used to reboil the column in a lower reboiler. The first portion is then cooled, expanded and introduced into the column as reflux. A second portion is compressed, cooled in heat exchange with warming product streams, expanded to recover work, further cooled in heat exchange with warming product streams, and reunited with the second substream prior to introduction in an intermediate location of the distillation column. The second substream is fed to a mole sieve unit for water and carbon dioxide removal, cooled in heat exchange with warming product streams, reunited with a second portion of the first substream, and introduced to the column at a intermediate location.

Preferably, in all of the above described configurations, the oxygen-enriched stream from the bottom of the distillation column is flashed through a JT valve before introduction into the outer shell of the condenser of the distillation column in order to reduce its temperature and pressure. Additionally, the oxygen-enriched product stream can be used to reactivate the molecular sieve dryer.

Advantageously, the molecular sieve dryer is comprised of a pair of switching adsorption beds in which both beds are packed with a molecular sieve material and used alternately for adsorption and regeneration.

DETAILED DESCRIPTION OF THE INVENTION

Figure 1:
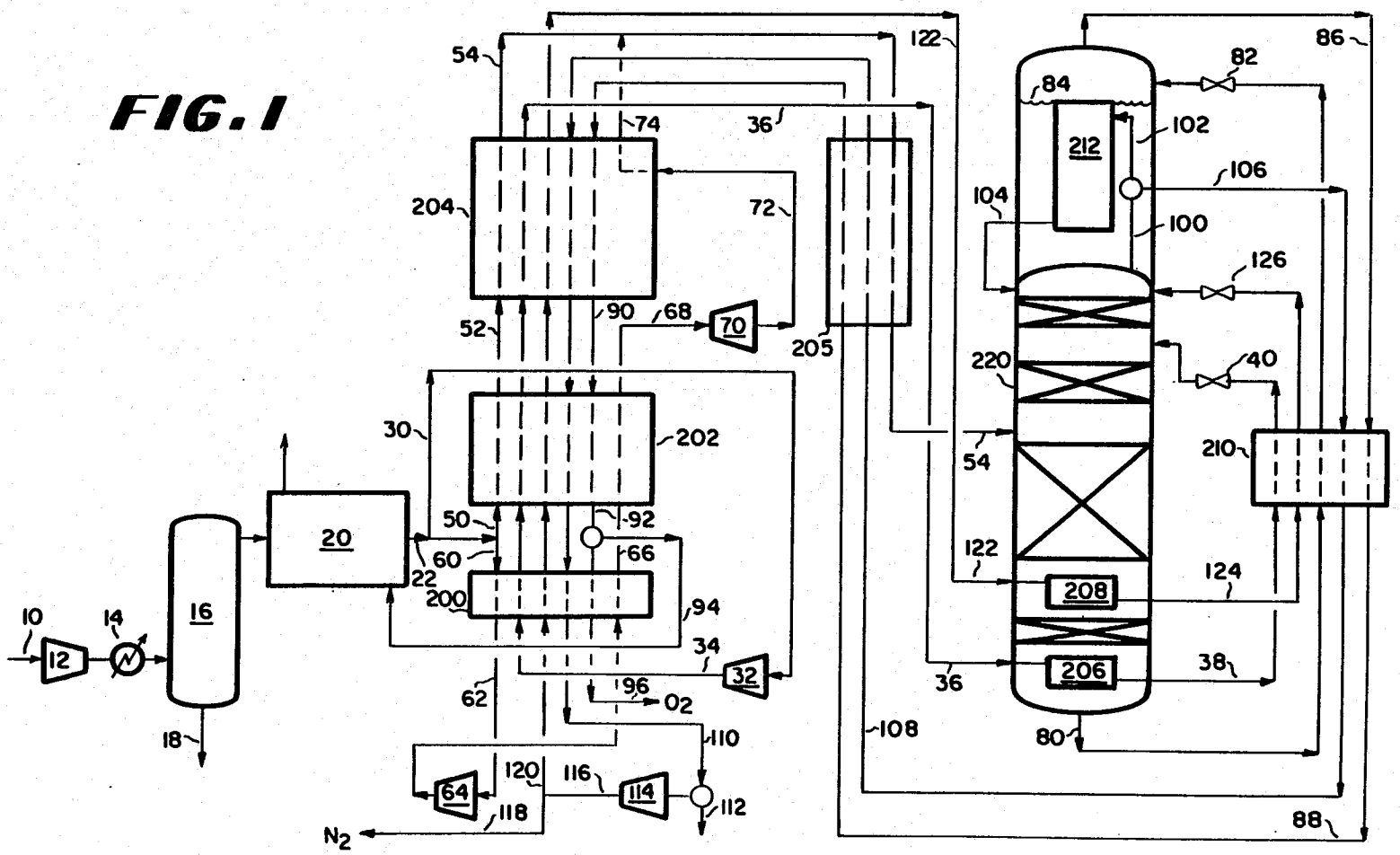
FIG. 1 is a schematic flow scheme of a preferred embodiment of the present invention.

The present invention will now be described in greater detail with respect to a preferred embodiment of the invention and two variations of it. With reference to FIG. 1, a feed air stream is introduced into the system via line 10 and is compressed to an elevated pressure in main air compressor 12. The heat of compression is removed from the air stream by heat exchange against an external cooling fluid, such as water at ambient conditions, in heat exchanger or aftercooler 14. The high pressure aftercooled feed air stream is then introduced into a knock-out drum 16 wherein condensed water and other heavy components, such as hydrocarbons, are removed as a liquid phase via line 18. Most of the condensables are removed in this apparatus, but residual moisture and carbon dioxide are still entrained in the feed air stream. To remove the residual water and carbon dioxide, the feed air stream is directed through a molecular sieve bed 20. The molecular sieve bed is preferably a pair of adsorption beds which are packed with a molecular sieve adsorbent. While one bed is in the adsorption stage removing water and carbon dioxide from the feed air stream, the other bed is in a regeneration stage in which a dry regeneration gas, preferably a process stream, such as a waste oxygen-enriched stream, is passed through the regenerating adsorption bed to remove adsorbed water and carbon dioxide. The duty on the beds is switched in a timed sequence corresponding to the adsorption capacity of the beds. Such an apparatus is generally referred to as a dryer and is known in the art specifically as switching adsorption beds.

The compressed and dried feed air stream in line 22 is then separated into three substreams, a first feed air substream 30, a second feed air substream 60 and a third feed air substream 50. The third feed air substream 50 is cooled by heat exchange in heat exchangers 202, 204 and 205 against process streams. This feed air substream is introduced via line 54 into a single pressure distillation column 220 at an intermediate level. The second feed air substream in line 60 is warmed in heat exchanger 200 against process streams, compressed to an elevated pressure in compressor 64 and cooled in heat exchangers 200 and 202; it emerges from exchanger 202 as line 68. This second cooled feed air substream 68 is then expanded in expander 70 to produce work for refrigeration and compression. The exhaust from expander 70, line 72 is then fed along with line 54 into an intermediate point of column 220. The first feed air substream in line 30 is compressed to a higher pressure in a supplemental air compressor 32 and aftercooled against external cooling fluid, such as ambient water. This cooling is not shown in the drawing. The high pressure substream in line 34 is then cooled in heat exchangers 200, 202 and 204 by heat exchange against process streams exiting as stream 36.

This substream in line 36 is then used to reboil distillation column 220 in a reboiler 206 which is located near the bottom of the column 220. The substream is condensed in the reboiler 206 as the substream heat exchanges with the bottoms liquid which is reboiled to send vapors upward through the column. The condensed substream is removed from the reboiler 206 in line 38 and is further cooled in subcooling heat exchanger 210 before being flashed through a JT valve 40 to a lower temperature and pressure before being introduced into distillation column 220 above the feed inlet of the remaining air stream.

An oxygen-enriched stream is removed from the bottom of the column 220 in line 80. This stream contains approximately 50 to 80% oxygen depending upon the overall nitrogen recovery of the system. The oxygen-enriched stream in line 80 is further cooled in subcooling heat exchanger 210 before being flashed to a reduced temperature and pressure through JT valve 82 and introduced into the sump outside the column condenser 212. The oxygen-enriched stream 84 in heat exchange with the condenser 212 is reboiled against a a portion of the nitrogen product removed from the top of the column in line 100. A nitrogen product stream is removed from the top of the column in line 106, while a nitrogen reflux stream is directed in line 102 through the condenser 212 to be condensed against the reboiling oxygen-enriched stream 84 and reintroduced into distillation column 220 by line 104 as a reflux stream for distillation column 220.

The vaporized oxygen enriched stream 84 from the sump of condenser 212 of distillation column 220 is removed in line 86 and rewarmed against process streams in subcooling heat exchanger 210. The warmed oxygen-enriched stream in line 88 is then further rewarmed against process streams in heat exchanger 205, 204, 202 and 200. A portion of the oxygen-enriched stream is removed before passage through heat exchanger 200 in line 94 and is used to regenerate the dryer 20, specifically, the regeneration of the molecular sieve bed presently in the regeneration stage. This gas, the oxygen-enriched stream, is essentially free of water and carbon dioxide and readily desorbs such components from the adsorbent material in the bed during the regeneration sequence. The spent regeneration gas may then be vented or used for utility requiring oxygen enrichment where water and carbon dioxide do not present a problem. The remaining oxygen-enriched stream passes through heat exchanger 200 and is further rewarmed before leaving the system in line 96. Again, the oxygen-enriched stream in line 96 may be used for utilities requiring oxygen-enrichment, but this stream is also free of water and carbon dioxide. Alternately, the stream may be vented to atmosphere.

The nitrogen product stream removed from stream 100 in line 106 contains essentially pure nitrogen which is rewarmed in subcooling heat exchanger 210 against process streams. The nitrogen product stream now in line 108 is further rewarmed by heat exchange against process streams in heat exchanger 205, 204, 202 and 200. The nitrogen product stream now in line 110 can be used in part for reactivation or purge duty in the system or a product at low pressure by removing a minor stream in line 112. The other portion of the nitrogen product stream in line 110 is then compressed to an elevated pressure in compressor 114. The elevated pressure level nitrogen product stream in line 116 is then split into a nitrogen recycle stream 120 and a pressurized nitrogen product stream in line 118. This pressurized nitrogen product stream in line 118 can be further compressed to provide nitrogen at yet higher pressure.

The nitrogen recycle stream in line 120 is cooled by heat exchange against process streams in heat exchangers 200, 202 and 204 and emerges as stream 122. The nitrogen recycle stream in line 122 is then introduced into the recycle reboiler 208 situated in the lower portion of distillation column 220, above the reboiler 206. The recycle stream reboils the rectifying streams in the column while condensing the nitrogen recycle stream which is removed in line 124. The combined nitrogen recycle stream is then subcooled in subcooling heat exchanger 210 against process streams. The subcooled combined nitrogen recycle stream is reduced in temperature and pressure by passage through a JT valve 126 before being introduced into the top of distillation column 220 as reflux.

Although not shown, a liquid stream may be withdrawn from the sump of condenser 212 and passed through a guard adsorber to prevent hydrocarbon buildup. This stream then would pass through a heat pump and re-enter the sump of condenser 212. A small liquid purge would also taken off the sump of condenser 212 for the same purpose.

This process is particularly attractive because it utilizes expansion of a part of the pressurized feed air stream to provide both refrigeration and compression. Efficient utilization of the power derived from this expansion is realized by the use of the expander generated power in the compressor of the feed air substream 30. The expander 70 and the compressor 32 can be interconnected in any known manner, such as by an electrical connection between an expander power generator and an electric motor driven compressor, or preferably by the mechanical linkage of the expander to the compressor in what is known in the art as a compander. This provides particularly efficient utilization of the power provided in the expander in the compression of the air feed in the compressor 32.

Figure 2:
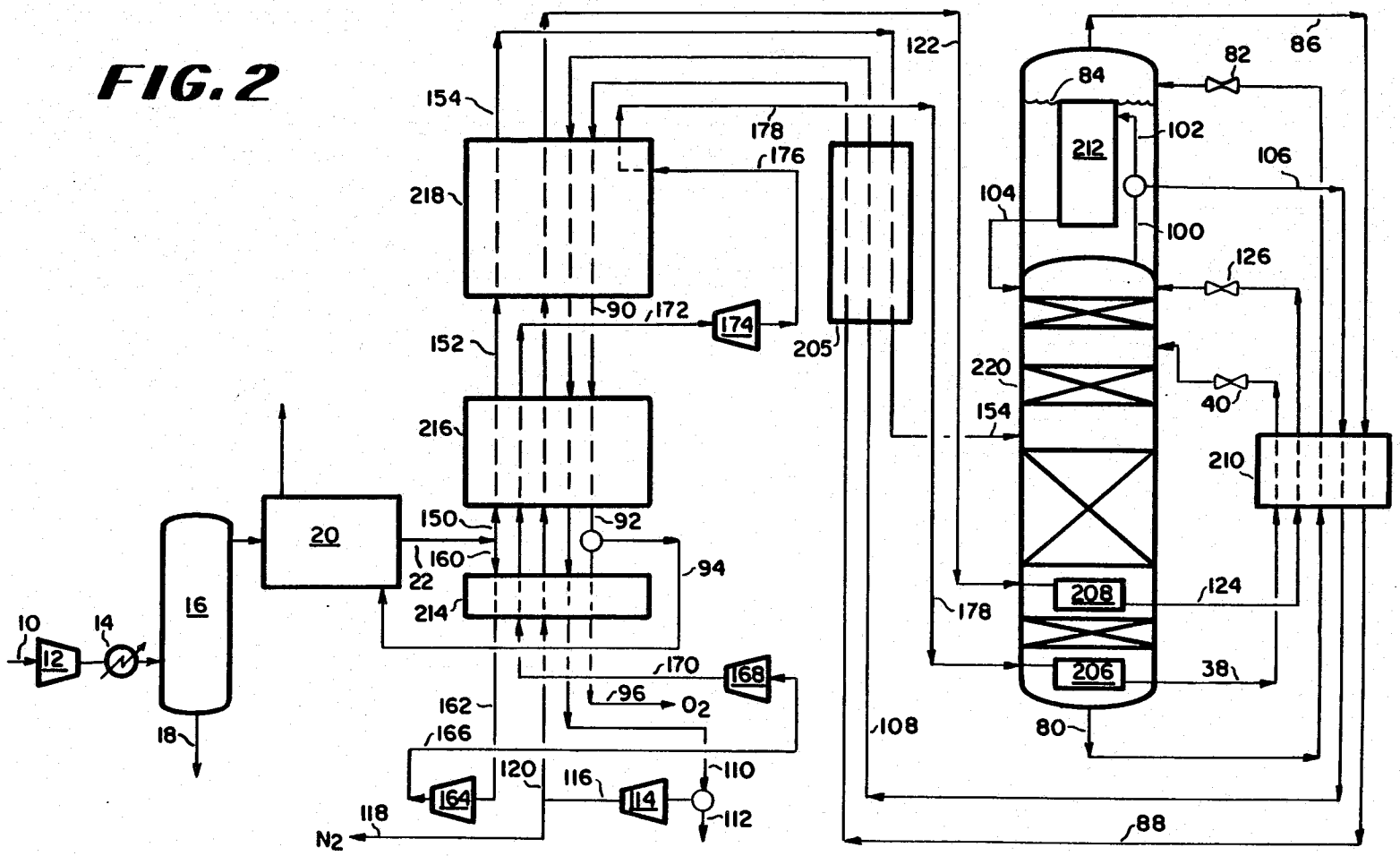
FIG. 2 is a schematic flow scheme of a first alternative to the preferred embodiment of the present invention.
Figure 3:
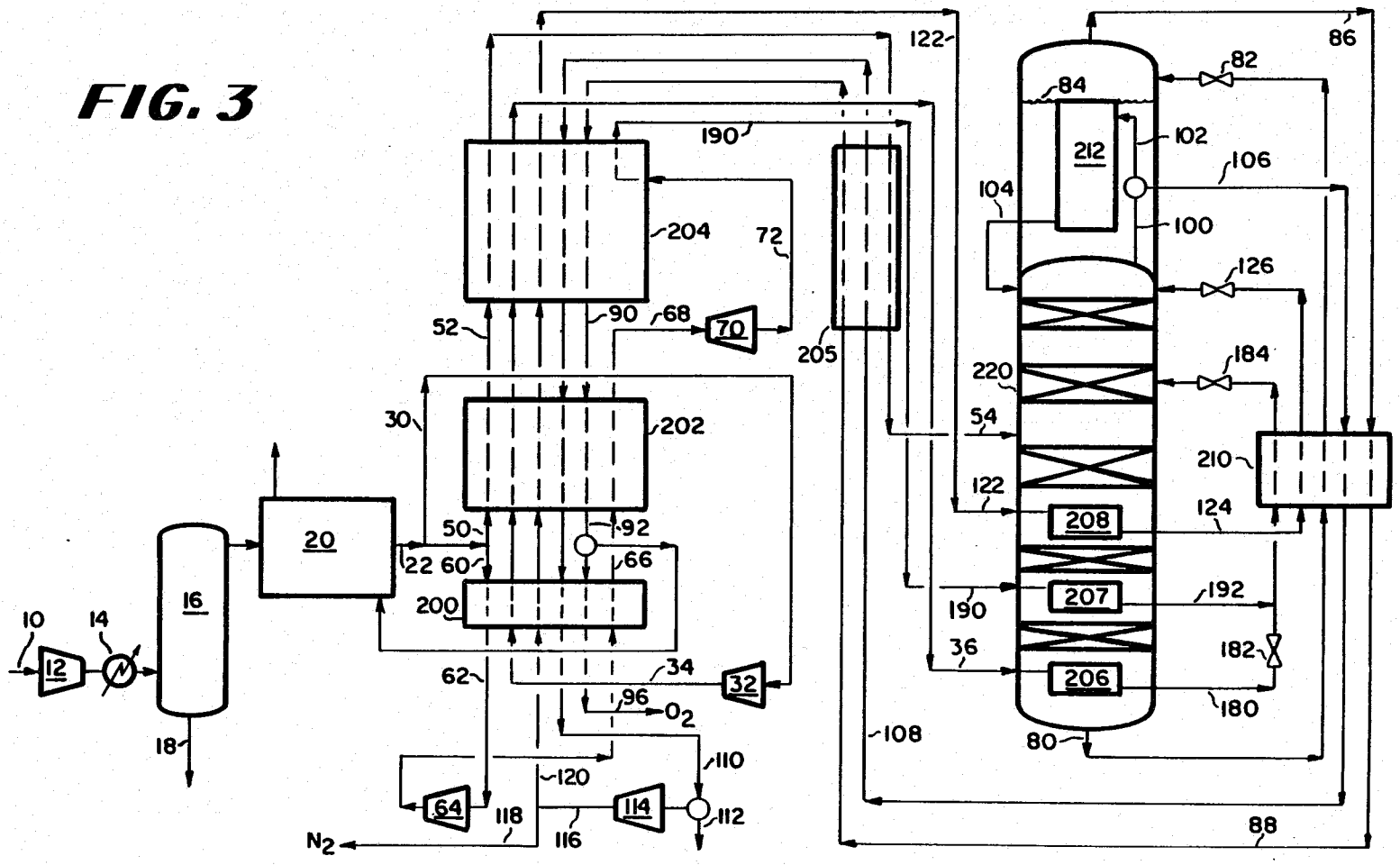
FIG. 3 is a schematic flow scheme of a second alternative to the preferred embodiment of the present invention.
Figure 4:
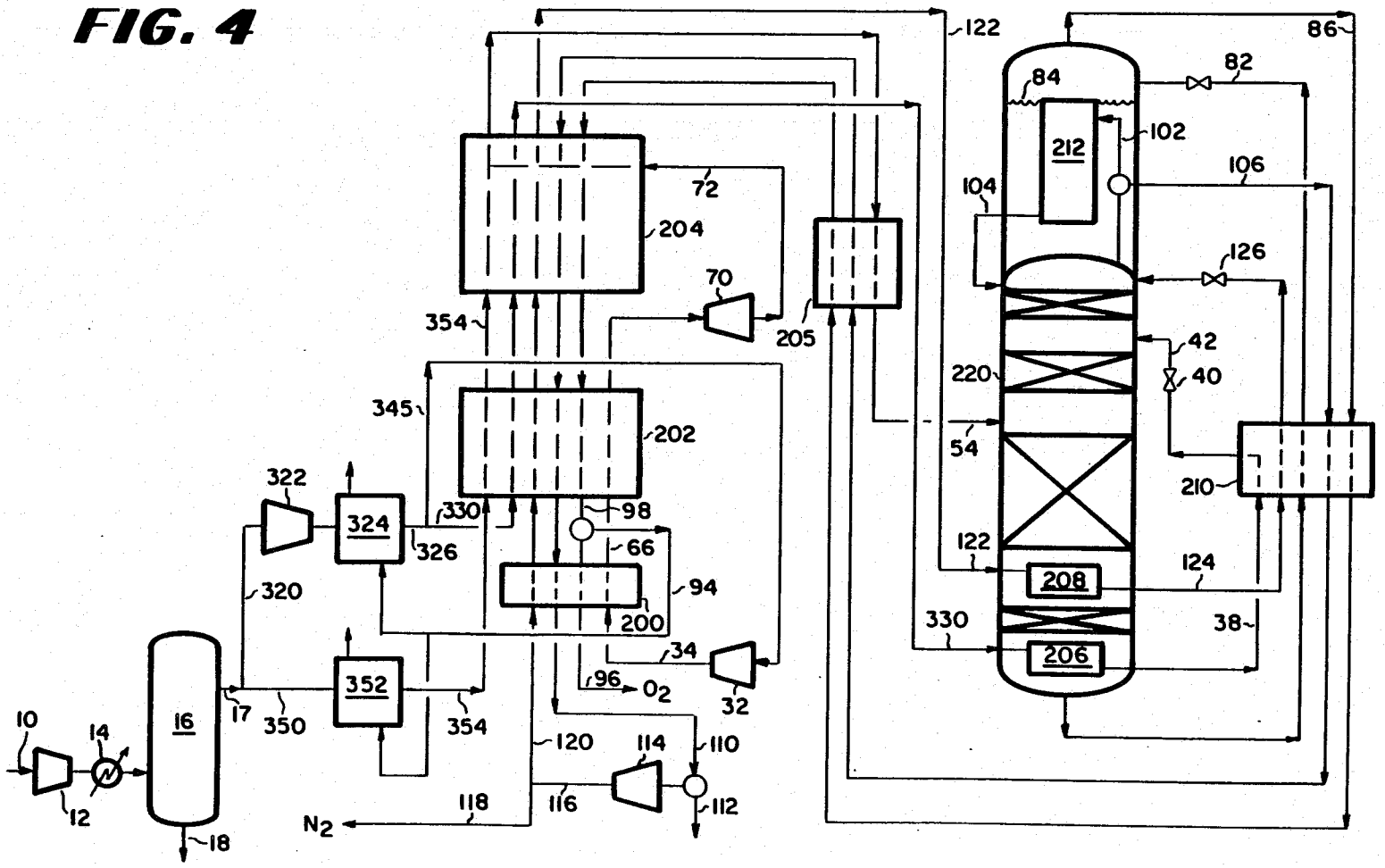
FIG. 4 is a schematic flow scheme of a third alternative to the preferred embodiment of the present invention.

Three variations on the above preferred embodiment are shown in FIG. 2, FIG. 3 and FIG. 4. In FIG. 2, the water and carbon dioxide free air in line 22 is split into two substreams. The first substream, line 160, is compressed in compressor 164 and further boosted in pressure in compressor 168. The compressed stream 170 is cooled in heat exchangers 214 and 216 and expanded in expander 174. The expanded stream 176 is cooled in exchanger 218, condensed in reboiler 206, further cooled in heat exchanger 210, expanded in expander 40, and fed to distillation column 220 at an intermediate location. The remaining air feed, line 150, is cooled in heat exchangers 216 and 218, and is fed to distillation column 220 at an intermediate location. The remainder of the process is the same as that depicted in FIG. 1.

In FIG. 3, air stream 22 is divided into three substreams. The only difference between this FIG. 3 and FIG. 1 is that the expanded air in line 72, is condensed in an additional reboiler 207 and is then mixed with condensed air feed stream 180, which has been expanded in a JT value 184. Trays between the reboilers are optional and it is possible to interchange the positions of reboilers 207 and 206 in distillation column 220.

In FIG. 4, air stream 17 is split into two substreams, lines 320 and 350, respectively. The first substream, line 320, is compressed to a high pressure in compressor 322, cooled in an aftercooler, not shown, and fed to mole sieve unit 324 for water and carbon dioxide removal. This high pressure substream, line 326, which is a large portion of the air feed, line 17, is split into two portions, lines 330 and 345. A first portion, line 330, is cooled in heat exchange, in exchangers 202, 204 and 205, with warming product streams and is used to reboil the column 220 in a lower reboiler 206. The first portion is then cooled in exchanger 210, expanded in expander 40 and introduced into the column as reflux in line 42. A second portion, line 345, is compressed in compressor 32, cooled in heat exchange in exchangers 200 and 202 with warming product streams, expanded to recover work in expander 70, further cooled in heat exchange with warming product streams in exchangers 204 and 205, and reunited with the second substream, line 354, prior to introduction in an intermediate location of distillation column 220. The second substream, line 350, is fed to mole sieve unit 352 for water and carbon dioxide removal, cooled in heat exchange with warming product streams in exchangers 202, 204 and 205, reunited with a second portion of the first substream, line 72, and introduced in to column 220 at a intermediate location.

The present invention will now be further described with reference to an example of air separation for the recovery of nitrogen gas at high pressure.

EXAMPLE

With reference to the preferred embodiment, FIG. 1, a feed air stream is introduced in line 10 into the air separation apparatus and compressed and aftercooled to a pressure of about 65 psia and a temperature of 25° C.

Approximately 82% of the feed air after drying is passed through the heat exchangers 202, 204 and 205 in line 50 and cooled to a temperature of −163° C. before being introduced as feed into distillation column 220 for rectification at a pressure of about 61 psia. About 8% of the feed air is split from the feed stream and is removed as a feed air substream in line 30. It is further compressed at 32 to a pressure of 107 psia and then aftercooled before being cooled in heat exchangers 200, 202 and 204 and introduced into the reboiler 206 at about −168° C. as vapor. This substream reboils the column while being condensed and leaves the reboiler at about −172° C. It is then cooled in the exchanger 210 and introduced into the column 220 as a second feed at approximately −179° C. About 10% of the feed air is split from the feed stream and is removed as a feed air substream in line 60. The line 60 substream is warmed in exchanger 200 to about 25° C. and compressed in compressor 64 to a pressure of 356 psia. The substream is further cooled in exchangers 200 and 202 to a temperature of about −105° C. The cooled substream is expanded in expander 70 to a pressure of 61 psia and fed to the column along with stream 54. An oxygen-enriched stream containing 67% oxygen is removed from the base of the column, is cooled, reduced in pressure and introduced into the overhead of the column outside the shell of the overhead condenser to condense a nitrogen reflux stream. The liquid oxygen is at approximately −187° F. Gaseous oxygen is then removed in line 86. A pure nitrogen product having 2 ppm of oxygen is removed in line 106 and is rewarmed before being compressed at 114 to about 125 psia. About 37% of the product is recycled in line 120, while the remaining nitrogen product is removed from the system. The system, as run, provides gaseous nitrogen at pressure, approximately 125 psia, and recovers approximately 88% of the total nitrogen processed by the system. To maintain the same evaluation basis, the nitrogen product is further compressed, not shown, to 213 psia.

The present invention provides a favorable improvement over known nitrogen generating air separation systems. As shown in Table 1 below, the present invention provides nitrogen at a reduced power requirement over a commonly assigned patented cycle disclosed in U.S. Pat. Nos. 4,400,188 and 4,464,188. The calculated power reduction of 0.6% is believed to be a significant reduction in air separation systems.

TABLE 1

| | U.S. PAT. NO. 4,400,188 | U.S. PAT. NO. 4,464,188 | PRESENT INVENTION |
|---|---|---|---|
| Power Required: KWH/NM$^3$ | 0.230 | 0.221 | 0.220 |
| Percent Improvement: | — | — | 0.6 |

The basis of the evaluation was at 50 MMSCFD, at nitrogen product of 5736 lb.moles/hr., at 2 ppm oxygen purity, ambient conditions of; 14.7 psia, 85° F. and 60% relative humidity, and product pressure at 213 psia.

As a further comparison, the energy requirements were calculated for the present invention as configured in FIG. 4. Using the same basis as above, the energy requirement for the FIG. 4 configuration is 0.216 KWH/NH$^3$. This represents an energy reduction of 2.1% over U.S. Pat. No. 4,464,188.

The present invention has been set forth with regard to specific preferred embodiments, but those skilled in the art will recognize obvious variations which are deemed to be within the scope of the invention, which scope should be ascertained from the claims which follow.

We claim:

1. A process for the separation of air by cryogenic distillation of the air in a distillation column comprising the steps of:

(a) compressing a feed air stream to an elevated pressure and aftercooling the pressurized air stream;

(b) removing water and carbon dioxide from the cooled pressurized air stream;

(c) splitting the feed air stream into three substreams;

(d) cooling a first substream in heat exchange against other process streams before introducing it into a distillation column;

(e) compressing a second substream and cooling it in heat exchange against process streams;

(f) reboiling the distillation column with the compressed second substream before reducing the pressure of the substream and introducing it into the column;

(g) cooling, compressing, and further cooling a third substream;

(h) expanding the cooled, compressed, third substream in an expander to recover work, further cooling the expanded substream and introducing it into the column;

(i) separating a nitrogen product stream and an oxygen-enriched stream from said distillation column;

(j) condensing a portion of the nitrogen product stream against the oxygen-enriched stream and returning it to the column as reflux;

(k) rewarming the remaining nitrogen product stream by heat exchange against process streams and compressing at least a portion of the product stream to an elevated pressure;

(l) splitting a nitrogen recycle stream from the compressed nitrogen product stream and cooling it against process streams; and (m) reboiling the distillation column with the recycle nitrogen stream before reducing it in pressure and introducing it into the column as reflux.

2. The process of claim 1 wherein the oxygen-enriched stream is removed from the column condenser and rewarmed in heat exchange against process streams.

3. The process of claim 1 wherein the feed air stream is passed through a molecular sieve adsorbent bed to remove residual water and carbon dioxide.

4. The process of claim 3 wherein at least part of the oxygen enriched product stream is used to regenerate the molecular sieve adsorbent bed.

5. The process of claim 1 wherein the oxygen-enriched stream is removed from the bottom of the distillation column, cooled by heat exchange against process streams and then reduced in temperature and pressure before being supplied to the condenser of the distillation column.

6. The process of claim 1 wherein the work recovered in step (h) is used to provide the compression requirements of step (e).

7. A process for the separation of air by cryogenic distillation of the air in a distillation column comprising the steps of:

(a) compressing a feed air stream to an elevated pressure and aftercooling the pressurized air stream;

(b) removing water and carbon dioxide from the cooled pressurized air stream;
(c) splitting the feed air stream into two substreams;
(d) cooling a first substream in heat exchange against other process streams before introducing it into a distillation column;
(e) cooling and compressing a second substream and further cooling it in heat exchange against process streams;
(f) expanding the cooled, compressed, second substream in an expander to recover work and further cooling the expanded substream;
(g) reboiling the distillation column with the expanded second substream before reducing the pressure of the substream and introducing it into the column;
(h) separating a nitrogen product stream and an oxygen-enriched stream from said distillation column;
(i) condensing a portion of the nitrogen product stream against the oxygen-enriched stream and returning it to the column as reflux;
(j) rewarming the remaining nitrogen product stream by heat exchange against process streams and compressing at least a portion of the product stream to an elevated pressure;
(k) splitting a nitrogen recycle stream from the compressed nitrogen product stream and cooling it against process streams; and
(l) reboiling the distillation column with the recycle nitrogen stream before reducing it in pressure and introducing it into the column as reflux.

8. The process of claim 7 wherein the oxygen-enriched stream is removed from the column condenser and rewarmed in heat exchange against process streams.

9. The process of claim 7 wherein the feed air stream is passed through a molecular sieve adsorbent bed to remove residual water and carbon dioxide.

10. The process of claim 9 wherein at least part of the oxygen enriched product stream is used to regenerate the molecular sieve adsorbent bed.

11. The process of claim 7 wherein the oxygen-enriched stream is removed from the bottom of the distillation column, cooled by heat exchange against process streams and then reduced in temperature and pressure before being supplied to the condenser of the distillation column.

12. The process of claim 7 wherein the work recovered in step (h) is used to provide the compression requirements of step (e).

13. A process for the separation of air by cryogenic distillation of the air in a distillation column comprising the steps of:
(a) compressing a feed air stream to an elevated pressure and aftercooling the pressurized air stream;
(b) removing water and carbon dioxide from the cooled pressurized air stream;
(c) splitting the feed air stream into three substreams;
(d) cooling a first substream in heat exchange against other process streams before introducing it into a distillation column;
(e) compressing a second substream and cooling it in heat exchange against process streams;
(f) reboiling the distillation column with the compressed second substream and reducing the pressure of the substream;
(g) cooling, compressing, and further cooling a third substream;
(h) expanding the cooled, compressed, third substream in an expander to recover work and further cooling the expanded substream;
(i) reboiling the distillation column with the expanded third substream;
(j) merging the third substream with the second substream before heat exchanging, reducing the pressure, and introducing it into the column;
(k) separating a nitrogen product stream and an oxygen-enriched stream from said distillation column;
(l) condensing a portion of the nitrogen product stream against the oxygen-enriched stream and returning it to the column as reflux;
(m) rewarming the remaining nitrogen product stream by heat exchange against process streams and compressing at least a portion of the product stream to an elevated pressure;
(n) splitting a nitrogen recycle stream from the compressed nitrogen product stream and cooling it against process streams; and
(o) reboiling the distillation column with the recycle nitrogen stream before reducing it in pressure and introducing it into the column as reflux.

14. The process of claim 13 wherein the oxygen-enriched stream is removed from the column condenser and rewarmed in heat exchange against process streams.

15. The process of claim 13 wherein the feed air stream is passed through a molecular sieve adsorbent bed to remove residual water and carbon dioxide.

16. The process of claim 15 wherein at least part of the oxygen enriched product stream is used to regenerate the molecular sieve adsorbent bed.

17. The process of claim 13 wherein the oxygen-enriched stream is removed from the bottom of the distillation column, cooled by heat exchange against process streams and then reduced in temperature and pressure before being supplied to the condenser of the distillation column.

18. The process of claim 13 wherein the work recovered in step (h) is used to provide the compression requirements of step (e).

19. A process for the separation of air by cryogenic distillation of the air in a distillation column comprising the steps of:
(a) compressing a feed air stream to an elevated pressure and after cooling the pressurized air stream;
(b) splitting the feed air stream into two substreams;
(c) further compressing, cooling, and removing water and carbon dioxide from a first substream;
(d) splitting said first substream into two portions;
(e) cooling a first portion in heat exchange with warming product streams and introducing said first portion for reboiling of the distillation column in a lower reboiler;
(f) further cooling, expanding, and introducing as reflux into said column, said first portion exiting from said lower reboiler;
(g) compressing a second portion to cooling prior to cooling on heat exchange with warming product streams;
(h) expanding and further cooling said second portion prior to reuniting with a second substream and subsequent introduction into the distillation column;
(i) removing water and carbon dioxide from a second substream;
(j) cooling in heat exchange with warming product;

(k) separating a nitrogen product stream and an oxygen-enriched stream from said distillation column;

(l) condensing a portion of the nitrogen product stream against the oxygen-enriched stream and returning it to the column as reflux;

(m) rewarming the remaining nitrogen product stream by heat exchange against process streams and compressing at least a portion of the product stream to an elevated pressure;

(n) splitting a nitrogen recycle stream from the compressed nitrogen product stream and cooling it against process streams; and (o) reboiling the distillation column with the recycle nitrogen stream before reducing it in pressure and introducing it into the column as reflux.

20. The process of claim 19 wherein the oxygen-enriched stream is removed from the column condenser and rewarmed in heat exchange against process streams.

21. The process of claim 19 wherein a molecular sieve adsorbent bed is used to remove residual water and carbon dioxide.

22. The process of claim 21 wherein at least part of the oxygen enriched product stream is used to regenerate the molecular sieve adsorbent bed.

23. The process of claim 19 wherein the oxygen-enriched stream is removed from the bottom of the distillation column, cooled by heat exchange against process streams and then reduced in temperature and pressure before being supplied to the condenser of the distillation column.

* * * * *